United States Patent [19]

Ueyama

[11] Patent Number: 4,976,555

[45] Date of Patent: Dec. 11, 1990

[54] SERIAL PRINTER CONTROL CIRCUIT ENABLING LINE FEED DURING CARRIAGE DECELERATION

[75] Inventor: Shuziro Ueyama, Tokyo, Japan

[73] Assignee: NEC Corporation, Tokyo, Japan

[21] Appl. No.: 269,097

[22] Filed: Nov. 9, 1988

[30] Foreign Application Priority Data

Nov. 9, 1987 [JP] Japan ..... 62-281021

[51] Int. Cl.[5] ..... B41J 19/70

[52] U.S. Cl. ..... 400/314.1; 400/322; 400/568

[58] Field of Search ..... 400/121, 124, 314, 314.1, 400/322, 323, 568

[56] References Cited

U.S. PATENT DOCUMENTS 4,169,991 10/1979 Ross ..... 400/322
4,284,362 8/1981 Jackson ..... 400/323
4,405,245 9/1983 Fukushima ..... 400/322
4,459,050 7/1984 Goldberg ..... 400/322
4,469,460 9/1984 Hughes ..... 400/124

FOREIGN PATENT DOCUMENTS 22765 2/1984 Japan ..... 400/314
54971 3/1986 Japan ..... 400/314.1

*Primary Examiner*—David A. Wiecking
*Assistant Examiner*—Steven S. Kelley
*Attorney, Agent, or Firm*—Sughrue, Mion, Zinn, Macpeak & Seas

[57] ABSTRACT

A serial printer control circuit having a motor control section which includes a single CPU, and a circuit which is controlled by the single CPU so as to perform printing in a period other than a acceleration/deceleration period of a spacing motor and perform paper feed by driving/controlling a line feed motor during a deceleration period of the spacing motor.

1 Claim, 4 Drawing Sheets

SERIAL PRINTER CONTROL CIRCUIT ENABLING LINE FEED DURING CARRIAGE DECELERATION

BACKGROUND OF THE INVENTION

The present invention relates to a serial printer control circuit for driving/controlling a spacing motor and a line feed motor by using a single CPU.

In a conventional serial printer control circuit for driving/controlling a spacing motor for moving a head and a line feed motor by using a single CPU, the CPU generates timing signals for controlling the driving speeds of the spacing motor and the line feed motor by using a programmable timer, and performs speed control in accordance with interruptions to the CPU using the timing signals. In such speed control, if the line feed motor is controlled by utilizing a deceleration period of the spacing motor, which does not contribute to a printing operation, two interruptions must be simultaneously allowed. Such multiple interruptions cause an error in timing of driving the motors. For this reason, the line feed motor must be driven only after the spacing motor is stopped, thereby degrading operation efficiency of the printer.

On the other hand, in a serial printer control circuit for driving the line feed motor during a deceleration period of the spacing motor by using two CPUs, since the number of CPUs is increased, the number of their peripheral circuits are increased, resulting in an increase in cost.

A serial printer control circuit capable of eliminating the above drawbacks has been proposed. This control circuit includes a timer for setting a predetermined line feed amount in a counter and operating a motor for a period of time corresponding to the value set in the counter in a predetermined cycle. With this arrangement, line feed is performed by utilizing an operation period of the spacing motor and its deceleration period. However, since acceleration/deceleration control of the motor cannot be performed, it is difficult to efficiently operate the motor at high speed.

SUMMARY OF THE INVENTION

It is an object of the present invention to provide an inexpensive serial printer control circuit which can eliminate the above-described drawbacks in the conventional techniques and which uses a single CPU without degrading operation efficiency of a printer.

According to the present invention, there is provided a serial printer control circuit having a motor control section comprising a single CPU, and means, controlled by the single CPU, for printing in a period other than an acceleration/deceleration period of a spacing motor, and performing line feed by driving/controlling a line feed motor in a deceleration period of the spacing motor.

DETAILED DESCRIPTION OF THE PREFERRED EMBODIMENT

An embodiment of the present invention will be described in detail below with reference to the accompanying drawings.

Figure 1:
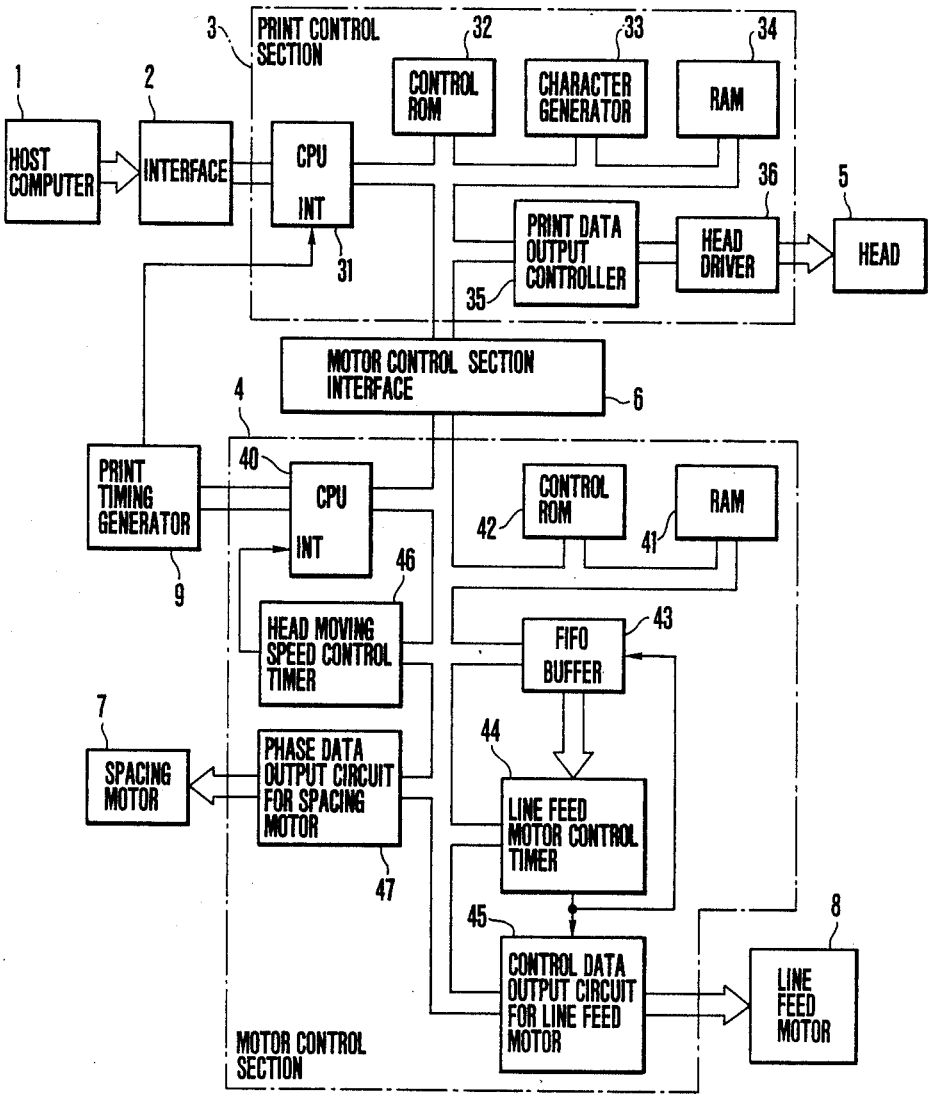
FIG. 1 is a block diagram showing an embodiment of the present invention.

FIG. 1 is a block diagram showing a serial printer control circuit according to the embodiment of the present invention.

Referring to FIG. 1, a host computer 1 supplies print data to a print control section 3 through an interface 2.

The print control section 3 includes a CPU 31, a control ROM 32, a character generator 33, a RAM 34, a print data output circuit 35, and a head driver 36. The print control section 3 produces one-line print data by using the data supplied from the host computer 1, and outputs it to a head 5. In addition, the control section 3 outputs motor control data through a motor control section interface 6 to a motor control section 4 for controlling a spacing motor 7 for driving the head, and a line feed motor 8.

The motor control section 4 constitutes a characteristic feature of the present invention, and will be described in detail below.

The motor control section 4 comprises a CPU 40 for controlling an overall operation of the control section 4 on the basis of motor control data supplied from the CPU 31 in the print control section 3, a RAM 41 to be used as a work memory for producing data, a control ROM 42 for storing speed parameters of the spacing and line feed motors 7 and 8, a FIFO (First In First Out) buffer 43 for storing control data read out from the RAM 41, a line feed motor control timer 44 for performing counting on the basis of the control data supplied from the FIFO buffer 43, reading out the next speed parameter data from the FIFO buffer 43 every time counting is ended, and automatically repeating this processing until the FIFO buffer 43 is emptied, a control data output circuit 45 for outputting the control data set in the CPU 40 to the line feed motor 8 every time the output circuit 45 is triggered by a control signal from the line feed speed control timer 44, the control signal representing an end of counting, a head moving speed control timer 46 for supplying an interruption for speed control of the spacing motor 7 to the CPU 40 on the basis of spacing motor control data set by the CPU 40, and a phase data output circuit 47 for receiving data, which is associated with a moving direction of the head, from the CPU 40 and outputting it to the spacing motor 7.

After the CPU 31 in the print control section 3 produces one-line print data by using data received from the host computer 1, the CPU 31 determines a moving amount of the spacing motor 7 and a line feed amount after one-line printing. Subsequently, the CPU 31 outputs control data for the spacing and line feed motors 7 and 8 to the CPU 40 in the motor control section 4.

The control data for the spacing motor 7 includes parameters of a head moving direction, a head moving distance ML, a head maximum moving speed S1, and a print range R.

Figure 2:
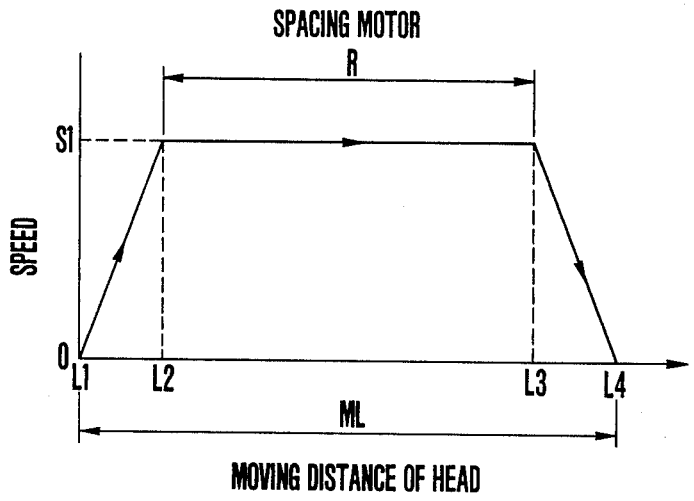
FIGS. 2 and 3 are graphs for explaining an operation of a circuit in FIG. 1.

A curve in FIG. 2 represents a relationship between these parameters. In FIG. 2, a distance from L1 to L2 corresponds to an acceleration period, and a distance from L3 to L4 corresponds to a deceleration period.

The control data for the line feed motor 8 includes parameters of a line feed direction, a feed amount FL, and a maximum feed speed S2.

Figure 3:
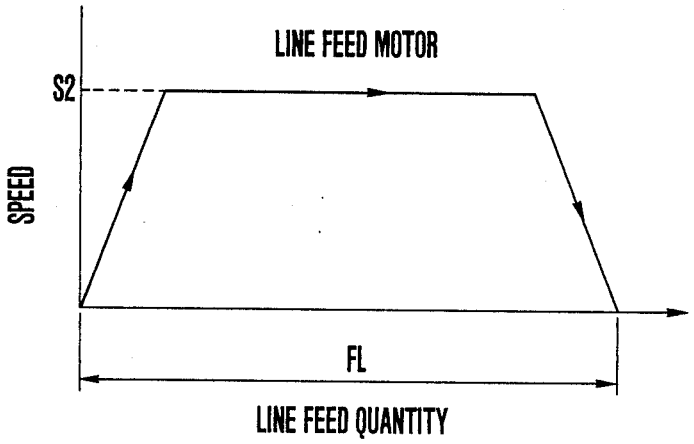

A curve in FIG. 3 represents a relationship between the parameters for the line feed motor 8.

The CPU 40 controls the spacing and line feed motors 7 and 8 on the basis of the above parameters supplied from the CPU 31 in the following manner.

Figure 4:
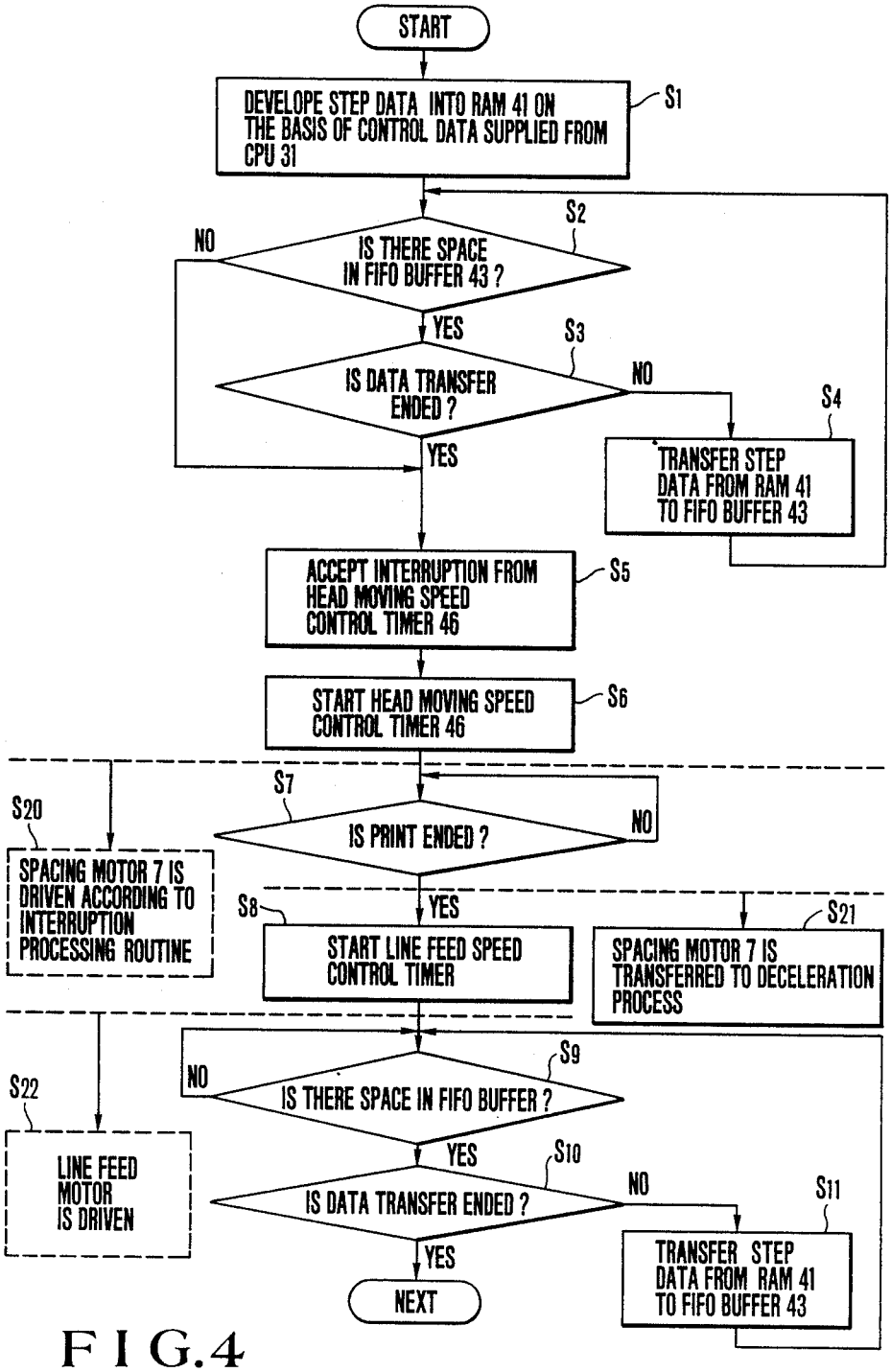
FIG. 4 is a flow chart for explaining the operation of the circuit in FIG. 1.

FIG. 4 is a flow chart of motor control performed by the CPU 40.

Referring to FIG. 4, in step S1, CPU 40 develops step data, which is used to accelerate/decelerate the line feed motor 8 in every motor step, in the RAM 41 on the basis of the respective control data.

Figure 5:
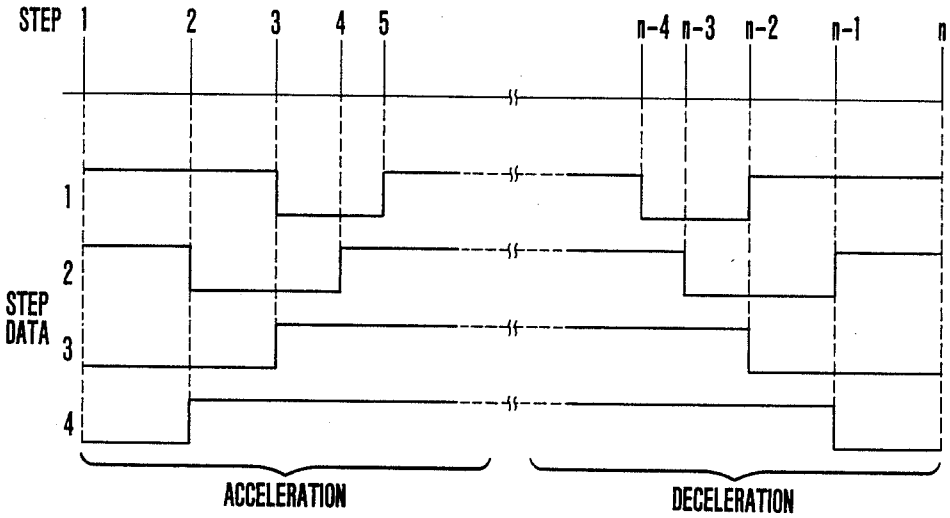
FIG. 5 is a chart showing an example of step data for a motor, which is stored in a FIFO buffer in FIG. 1.

FIG. 5 shows an example of acceleration/deceleration data SDl to SDn for the line feed motor 8 in steps STEPl to STEPn when a two-phase two-excitation motor is used as the motor 8.

Figures 6, 7A, 7B:
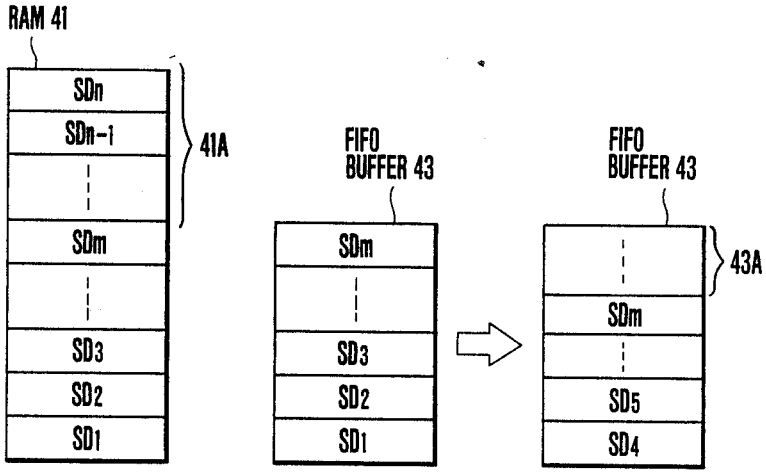
FIG. 6 is a data map showing a state of data stored in a RAM 41 in FIG. 1.
FIGS. 7A and 7B are data maps each showing a state of data stored in the FIFO buffer in FIG. 1.

FIG. 6 shows a state of data SDl to SDn stored in the RAM 41, which correspond to the steps STEPl to STEPn of the line feed motor 8.

In step S2 in FIG. 4, it is checked whether a space is present in the FIFO buffer 43. If YES in step S2, the flow advances to step S3. If NO in step S2, the flow jumps to step S5. If the space is present in the FIFO buffer 43 and transfer of necessary data is completed in step S3, the flow advance to step S5. If the transfer is not completed, the flow advances to step S4. In step S4, step data for the line feed motor 8 is transferred to the FIFO buffer 43.

FIG. 7A shows a state of a full capacity of the FIFO buffer 43 due to the processing in steps S2, S3, and S4 in the above flow chart when the capacity is m ($m<n$). Data denoted by reference symbol 41A in FIG. 6, which cannot be set in the FIFO buffer 43, is later transferred to a space denoted by reference symbol 43A in FIG. 7B when the space 43A is formed in the FIFO buffer 43.

In FIG. 4, in step S5, an interruption of the spacing motor 7 is accepted. In step S6, the head moving speed control timer 46 is started. With this operation, as shown in a block S20 indicated by a dotted line in FIG. 4, the CPU 40 drives the spacing motor 7 by processing the interruption from the head moving speed control timer 46 according to an interruption processing routine, thereby printing characters or the like.

When printing is ended in step S7, the CPU 40 performs deceleration control while receiving the interruption from the head moving speed control timer 46, as shown in a block S21 indicated by a dotted line. With this operation, the process of the spacing motor 7 is transferred to a deceleration process. In step S8, i.e., at the time when the process of the spacing motor 7 is transferred to the deceleration process (time L3 in FIG. 2), the line feed motor control timer 44 is started and the line feed motor 8 is driven. The line feed motor control timer 44 which has been started outputs a trigger to the control data output circuit 45 for the line feed motor 8 after counting is ended. With this operation, the control data output circuit 45 for the line feed motor 8 is operated, and phase data is output to the line feed motor 8. As a result, the line feed motor 8 is driven and line feed is performed.

In step S9, the CPU 40 checks whether a space is formed in the FIFO buffer 43 during an idle time of the control interruption processing of the spacing motor 7. If a such space 43A as shown in FIG. 7B is present, steps S10 and S11 are repeated until the FIFO buffer 43 is filled up or transfer of a predetermined amount of data is completed. When data transfer is ended, the flow can advance to the next control operation.

As has been described in detail, according to the serial printer control circuit of the embodiment, since speed data which is to be supplied to the FIFO buffer 43 is stored in the RAM 41, the acceleration/deceleration and speed of each motor can be arbitrarily changed. In addition, since the line feed motor 8 can be simultaneously controlled while deceleration of the spacing motor 7 is performed, operation efficiency of the printer can be improved.

According to the present invention, the spacing and line feed motors 7 and 8 in the above embodiment can be reversely controlled, and the spacing motor 7 can be controlled by using the FIFO buffer so as to decrease the load of the CPU 40.

What is claimed is:

1. A serial printer control circuit for driving/controlling a spacing motor and a line feed motor by using a single CPU, comprising:

memory means for storing speed parameters for said head driving and line feed motors, which are supplied from said CPU;

a FIFO (First In First Out) buffer, controlled by said CPU, for receiving the speed parameters for said line feed motor from said memory means and storing the received parameters as timer data;

a timer for fetching the timer data until said FIFO buffer becomes empty, automatically starting an operation and counting in accordance with each timer data, and generating a trigger when counting based on the timer counter is ended; and a control data output circuit for outputting control data representing a line feed direction of said line feed motor to said line feed motor in response to the trigger, wherein said CPU performs control such that printing is performed in a period other than an acceleration/deceleration period of said spacing motor, and line feed is performed by starting said timer in a deceleration period of said spacing motor.

* * * * *